United States Patent [19]

McMillin

[11] 4,216,879

[45] Aug. 12, 1980

[54] METHOD OF AND APPARATUS FOR DISPENSING A HIGH VOLUMETRIC FLOW RATE OF CARBONATED BEVERAGE, HAVING PARTIAL REVERSAL OF A CIRCULATING FLOW

[75] Inventor: John R. McMillin, Maplewood, Minn.

[73] Assignee: The Cornelius Company, Anoka, Minn.

[21] Appl. No.: 934,158

[22] Filed: Aug. 16, 1978

[51] Int. Cl.[3] ..... B65D 83/14

[52] U.S. Cl. ..... 222/1; 137/209; 137/340; 137/563; 222/146 C; 222/318; 222/399; 222/488

[58] Field of Search ..... 222/1, 146 R, 146 C, 222/318, 330, 380, 399, 482, 488; 137/209, 340, 563; 62/389, 434

[56] References Cited

U.S. PATENT DOCUMENTS

| | | | |
|---|---|---|---|
| 3,011,681 | 12/1961 | Kromer | 222/146 C X |
| 3,255,920 | 6/1966 | Cornelius | 222/318 X |
| 3,370,755 | 2/1968 | Querner | 222/318 X |
| 3,892,335 | 7/1975 | Schroeder | 222/146 C X |

*Primary Examiner*—Robert J. Spar
*Assistant Examiner*—Fred A. Silverberg
*Attorney, Agent, or Firm*—Henry C. Kovar

[57] ABSTRACT

A method of dispensing includes the steps of carbonating a beverage, storing a supply of the carbonated beverage, conducting the carbonated beverage from the supply and into a circulation loop, circulating the carbonated beverage in a predetermined direction around the loop at a predetermined rate of volumetric flow, selectively dispensing carbonated beverage from the loop at a volumetric rate of flow greater than the circulation flow rate, reversing the direction of flow of carbonated beverage in the return part of the loop during the dispensing, and conducting carbonated beverage from the supply to the dispensing outlet in both the predetermined and reverse direction while cooling both the predetermined direction and reverse direction of flows; apparatus for dispensing includes a carbonator, a storage receptacle for carbonated beverage, a carbonated beverage circulation loop conduit having a pump, a delivery line, a return line, and one or more dispensing valves; a beverage supply conduit connects the storage receptacle to the return line and a beverage supply connector conduit connects the return line to the delivery line, a check valve in the connector conduit precludes beverage flow from the delivery line to the return line, and both of the delivery and return lines having cooling coils in a common heat sink.

56 Claims, 1 Drawing Figure

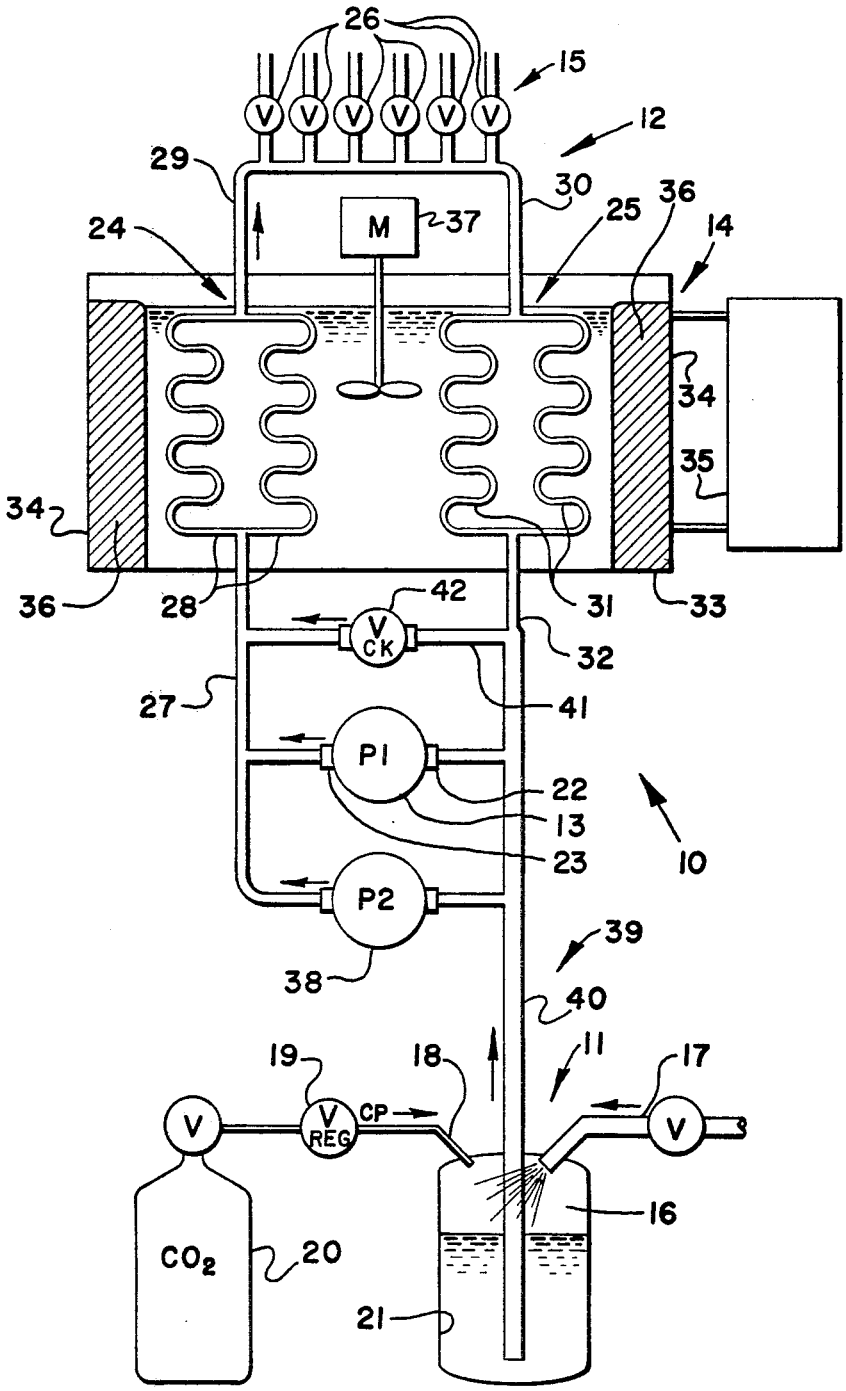
26
15
12
29
30
36
25
14
24
M
37
34
35
34
36
28
31
33
42
V
CK
32
27
41
P1
22
13
23
10
P2
39
38
40
11
19
18
17
V
V
REG
CP
V
16
$CO_2$
20
21

METHOD OF AND APPARATUS FOR DISPENSING A HIGH VOLUMETRIC FLOW RATE OF CARBONATED BEVERAGE, HAVING PARTIAL REVERSAL OF A CIRCULATING FLOW

BACKGROUND OF THE INVENTION

1. Field of the Invention

This invention pertains to a method and apparatus for dispensing a carbonated beverage, in which the beverage is circulated through a loop.

2. Description of the Prior Art

The prior methods and apparatus for dispensing of carbonated beverage is referred to as a "soda circuit" or "remote dispensing system". The idea is to provide a carbonation and refrigeration module connected by a long length of thermally insulated tubing to a remote dispensing head. The carbonation and refrigeration module or components are typically in the back room, basement, attic, supply or utility room. The dispensing head will be on a retail bar and be exposed to customers, in a kitchen, or in some place of access convenient to retail customers. Typically, the refrigeration and dispensing head may be anywhere from 10 feet (3 m) to 300 feet (90 m) apart from one another and may be separated on different levels of a building floor. Thermally insulated tubing connects the carbonation and refrigeration to the dispensing head. The tubing is typically built into floors and walls and snakes around and through the structure of the building.

A water circulation pump has been provided for circulating refrigerated water or either flat cooling water from an ice bank or else the actual carbonated water, through the insulated tubing. The refrigerated water is circulated from the refrigeration module to the dispensing head and back to the module. The circulating water cools the circulation tubing and the beverage concentrate in tubing adjacent to the water tubing, and the dispensing head and dispensing valves in the head.

A tremendous amount of development has been done on solving the problems of dispensing a cold drink, providing high and accurate levels of carbonation, preventing foaming or breakout of carbonation and running long distances when separate refrigeration modules and dispensing heads are utilized. Ingenious, diverse and effective solutions have been developed for these problems, and "soda circuits" and/or remote beverage refrigeration systems are in widespread use, particularly in fast food retailing stores.

The state-of-the-art soda circuit has a carbonator with a storage reservoir under gas pressure, a refrigeration module, a circulation conduit extending through the refrigeration module and with a delivery line and a return line, a pump between the return line and the delivery line circulates water and the carbonator is connected to deliver beverage through the delivery line to dispensing valves numbering anywhere from three to six or even more, connected to the delivery line.

The problems are dispensing capacity, and quality of water to concentrate ratio.

Typically, only two dispensing valves can be operated concurrently. Pressure drop from flow reduces the water flow rates out of dispensing valves and the drinks become too rich, having too much concentrate in respect to water.

One solution to the capacity problem is to go to larger tubing; but this increases costs, cooling requirements, energy consumption, and the thermal efficiency of the apparatus decreases.

Fast food retail locations now want to connect ten or more dispensing valves into a soda circuit and to be able to use five or more dispensing valves at one time, i.e. concurrently. They also want proper proportioning of water to concentrate. They want the dispensing rate of each valve in the increased number of valves doubled over the existing dispensing apparatus. Specifically, present individual dispensing valves have a total flow capacity of 1.5 oz./sec. (44 $cm^3$/sec.) and retailers want this increased to 3.0 oz./sec. (88 $cm^3$/sec.).

OBJECTS OF THE INVENTION

It is an object of the present invention to provide a new method and apparatus for dispensing a carbonated beverage in a vastly increased volumetric flow rate.

It is an object of the present invention to provide a new method and apparatus for dispensing a carbonated beverage which increases the quality of the beverage by increasing the accuracy of the proportioning of beverage constituents and of total volumetric flow rates.

It is an object of the present invention to provide a new method and apparatus for dispensing a vastly increased volumetric rate of carbonated beverage utilizing existing tubing lines now providing much lesser volumetric flow rates.

SUMMARY OF THE INVENTION

A method of dispensing carbonated beverage includes the steps of storing a supply of carbonated beverage under gas pressure, propelling the beverage from the supply into a circulation loop, circulating the beverage around the loop in a predetermined direction of flow past a dispensing outlet, dispensing the beverage via the outlet, and concurrently with the step of dispensing the direction of the beverage flow is reversed in part of the loop and beverage is propelled from the supply in the reversed direction to the dispensing outlet; apparatus includes means for storing a supply of beverage under propellant gas pressure, a beverage circulating loop having circulating means, a delivery line from the circulating means, a return line connecting the delivery line back to the circulating means, and a dispensing valve in between and connected to the delivery and return lines, a supply conduit connects the storage means to both of the return line and the delivery line, and precluding means in the supply conduit enables flow of beverage from the supply into the delivery line but precludes flow from the delivery line into the supply conduit, and beverage flows directly from the supply to the dispensing valve during dispensing in a direction of flow reversed from the circulation flow.

BRIEF DESCRIPTION OF THE DRAWING

The drawing is a schematic representation of the preferred embodiment of a beverage dispensing apparatus provided in accordance with the present invention, and for the practice of the preferred embodiment of the method of the present invention.

DESCRIPTION OF THE PREFERRED EMBODIMENT

The principles of the present invention are particularly useful when embodied in or practiced with a carbonated beverage dispensing apparatus such as that schematically illustrated in the drawing and indicated by the numeral 10. The dispensing apparatus 10 includes a beverage supply 11, a circulation loop conduit 12, a circulation pump 13, a refrigeration module 14, and a dispensing head 15.

The supply 11 includes a carbonating chamber 16 to which are connected a flat water supply line 17, and a carbon dioxide gas line 18 having an adjustable constant gas pressure regulator 19 which is connected to a carbon dioxide gas vessel 20. Water and carbon dioxide gas are admitted into the carbonating chamber 16, mixed together forming carbonated water and stored as a supply in the storage receptacle 21 which is in fluid communication with the carbonating chamber 16.

The circulation loop conduit 12 includes the pump 13, a delivery line 24 fluidly connected to an outlet 23 of the pump 13, a return line 25 fluidly connecting the delivery line 24 to an inlet 22 of the pump 13, and normally closed dispensing valves 26 in the dispensing head 15 and in fluid communication with and between the delivery line 24 and return line 25.

The delivery line 24 has an upstream inlet end 27 fluidly connected directly to the pump outlet 23, a central section defined by beverage cooling coils 28 which are in parallel, and a downstream outlet end 29 extending from the cooling coils 28 to the dispensing head 15.

The return line 25 has an upstream inlet end 30 fluidly connected to the downstream end 29 of the delivery line 24 and just downstream of the dispensing head 15. The upstream end 30 fluidly leads to beverage cooling coils 31 and from there to a downstream outlet end 32 which is in direct fluid communication with and connected to the pump inlet 22.

The beverage cooling coils 28, 31 are tubular metal coils each having parallel conduits. The cooling coils 28, 31 are discrete from one another but are of substantially equal thermal capacity and preferably are identical structure and are physically interchangeable. The cooling coils 28, 31 are immersed in a common heat sink 33 which is preferably an ice bath system having an evaporator wall 34, a refrigeration system 35, an inventory of ice 36 and a motor 37 for circulating water around and between the coils 28, 31 and ice 36.

The pump 13 is a positive displacement type having an output of constant volumetric flow rate. An example of this volumetric flow rate is 1 oz./sec. (30 $cm^3$/sec.), and an example of the volumetric flow rate of each valve 26 is 1.25 oz./sec. (37 $cm^3$/sec.). The pump 13 may be of less volumetric flow than any individual valve 26; the pump is sized to have volumetric flow sufficient to keep the dispensing head 25 cold.

A second pump 38 may also be in the loop conduit 12, and is fluidly connected in parallel with the first pump 13. Normally the second pump 38 will not run and will be held in reserve in the event of failure of the first pump 13, or alternatively both pumps may be run concurrently on abnormally hot days if the thermal load of cooling the dispensing head 15 exceeds the thermal cooling capability of the output of the first pump 13.

A carbonated beverage supply conduit 39 including a supply main conduit 40 and a supply connector conduit 41 connects the supply storing receptacle 21 to the circulation loop conduit 12. The supply main conduit 40 is preferably of about twice the internal area of either of the delivery line 24 or return line 25, and connects the storing receptacle 21 fluidly directly to the return line 25, the cooling coils 31, the dispensing valves 26 and to the pump inlet 22, via and through the return line 25. The connector conduit 41 connects the storing receptacle 21 and the return line 25 to the inlet end 27 of the delivery line 24 in between the pump outlet 23 and the cooling coil 28, and the main conduit 40 connects to the outlet end 32 of the return conduit 25 between the cooling coil 31 and the pump inlet 22. The pump 13, connector conduit 41 and return line 25 are all connected in parallel to the main supply conduit 40 and the pump 13 and connector conduit 41 are both on the same side of the cooling coils 28, 31 and the cooling coils 28, 31 are disposed in between the dispensing valves 26 and the connector conduit 41.

A valve 42 in the connector conduit 41 allows flow of beverage from the return line 25 or the main supply conduit 40 into the delivery line 24, but precludes flow of beverage from the delivery line 24 to the return line 25. The valve 42 is preferably a pressure responsive and actuatable automatic check valve which has a volumetric flow rate greater than the volumetric output flow of the pump. When the pressure in the delivery line inlet 27 is 2 to 4 PSIG (0.15 to 0.30 $Kgm/cm^2$) less than the pressure in the return line outlet 32, the valve 42 will automatically open.

The physical size of the delivery line 24 and return line 25 is substantially identical. The cooling coils 28, 31 are 8 mm outside diameter stainless steel with 6.5 mm inside diameter. The tubing for inlets 27, 30, outlets 29, 32 and connector conduit 41 are 9.5 mm inside diameter polyethylene. The main supply conduit 40 is about 12.5 mm inside diameter polyethylene. The greater diameter of the main supply conduit 40 should be maintained until the connector conduit 41 extends therefrom or the return line connects thereto. The length of the delivery line outlet end 29 and return line inlet end 30 is much greater than proportionally shown; as an average example, they may each be 100 feet (30 m) or up to 300 feet (90 m). The foregoing structural examples are sized for supplying dispensing valves 26 having flow capacities of 1.2 oz./sec. (35 $cm^3$/sec.). Dispensing valves 26 having greater flow rates require larger tubing. Each of the dispensing valves 26 also includes a volumetric flow regulator for maintaining a predetermined and fixed volumetric flow rate regardless of varying pressure within the loop conduit.

In the method of the present invention, as practiced utilizing the dispensing apparatus 10, the storing receptacle 21 will be filled with carbonated beverage, specifically carbonated water, having about 4½ volumes of carbonation, having a temperature of about 80° F. (37° C.), and under carbon dioxide gas propellant pressure of 100 PSIG (7.0 $Kg/cm^2$). The carbonated beverage is conducted into the circulation loop conduit 12, and air is bled out of the loop conduit 12 via dispensing valves 26. The carbonated beverage is circulated by the pump 13 at a constant volumetric rate of about 25 GPH which is 0.9 oz./sec. (26 $cm^3$/sec.). The circulation flow goes only in one predetermined direction. The flow leaves the pump 13 via outlet 23 and goes into and through the delivery line 24, via the inlet 27, the cooling coils 28 and outlet end 29 to the dispensing head 25. Provided that the dispensing valves 26 are closed, as is normal, the circulation flow continues past the dispensing head 15 and into the return line 25 for return to the pump 13 via the inlet end 30, cooling coils 31, outlet end 32 and pump inlet 22. This circulation is continuous because the pump 13 runs continually and the circulating flow always goes in the same direction, out the delivery line 24 and back the return line 25. The ice bank 33 will cool the coils 28, 29 and heat from the pump 13 is removed in the delivery line coils 28, the circulating beverage is then delivered to the dispensing head 15 at a temperature of just above 0° C., and after leaving the dispensing head 15, the heat from the head 15 is removed when the circulating beverage is recooled to 0° C. by the return line coils 31. The circulation just continues without interruption as long as the dispensing apparatus 10 is on stand-by and waiting to be used. The dispensing head 15 and valves 26 are kept very cool and the thermal efficiency is high because of minimal thermal input into the beverage by the pump 13. The ice bank 36 is substantial in thermal absorption potential, and is maintained as a common heat sink.

The step of selective dispensing is started by opening one, more or all of the dispensing valves 26 and withdrawing and dispensing carbonated beverage from the loop conduit 12. The volumetric flow rate of the beverage being dispensed far exceeds the flow rate of the pump 13 and to supply the valves 26 with cooled carbonated beverage, the valve 42 opens and connects the main supply conduit 40 directly to the delivery line 24, and the direction of flow of carbonated beverage in the return line 25 is reversed and beverage flows directly from the main supply conduit 40, through the return line 25 and to the dispensing head 15 and the opened dispensing valves 26. The beverage being dispensed is propelled by the gas pressure on the beverage in the receptacle 21 and as the propelled beverage flows through the main supply conduit 40, it is divided into separate streams of flow, the first stream of flow is propelled through the connector conduit 41 and its valve 42 and into the delivery line 24 in the predetermined direction of flow. The second stream of flow is propelled in a reverse direction into the return line 25 and in a flow toward the dispensing head 15. A third stream of flow is drawn into the pump 13 and replaces the normal returning circulating flow in the pump 13 and in the part of the loop conduit 12 immediately to either side of the pump 13. After the third stream is pumped, it is combined with the first stream at the junction of the connector conduit 41 and delivery inlet end 27 forming a single flow in the predetermined direction but of substantially increased volumetric rate as compared to the normal circulation flow. This combined flow then is propelled in the predetermined direction out the delivery line 24. As the flow goes through the coils 28 the beverage is cooled to 0° C., and then through the outlet end 29 to dispensing valves 26. The second stream goes into the return line 25 and into and through the return line coils 31 in the reverse direction where the carbonated beverage is initially and completely cooled to 0° C., and from the coils 31 to and through the inlet end 30 and then to the dispensing valves 26. Both of the predetermined flow in line 24 and reverse the flow in return line 25 of carbonated beverage during dispensing are cooled to substantially the same temperature, specifically 0° C., and this cooling is effected simultaneously by heat exchange to the singular and common ice bank 33. During the dispensing flow, when at or approaching maximum volume, the volumetric reverse flow rate in the return line 25 is much greater than the normal circulating flow in the return line 25, and is approximately equal to the volumetric rate of flow in the predetermined direction through the delivery line 24, and to the combined volumetric flow rates of the first and third streams. The volumetric flow rate of the third stream is about the same as the normal volumetric circulation flow rate. The flowing beverage in the loop conduit 12 during dispensing is flowing in parallel from the supply conduit 40 to the dispensing head 15 during dispensing. The flow in the predetermined direction in the delivery line 24 is flowing in parallel to the reverse flow in the return line 25, and both of the flows are recombined in the dispensing head 15 for dispensing out of the valves 26. During the dispensing, approximately one half of the beverage is supplied by the delivery line 24, and the other and approximately equal one half is supplied by the return line 25, and the open dispensing valves 26 draw equally upon the two flows during dispensing.

The volumetric rate of dispensing may be selectively increased or decreased during dispensing. For example, in the dispenser head 15 there are shown six dispensing valves 26. A person may want a discrete cup of beverage from each of the valves 26 and walk up with six cups, place the cups under the valves 26 and sequentially turn on, one by one, all of the valves 26. As the first valve is opened, or as soon as a volumetric dispensing rate in excess of the volumetric pumped circulation is reached, the flow of beverage in the return line 25 is reversed, the valve 42 opens up and directly connects the delivery line 24 to the receptacle 21 and beverage flows toward the valves 26 in both of the delivery and return lines 24, 25. As more and finally all of the valves 26 are opened, the total volumetric flow rate in the delivery and return lines 24, 25 are simultaneously sequentially increased, with about half of each flow increase being in the predetermined direction flow in the delivery line 24 and an equal and other half being in the reverse direction flow in the return line 25. As the valves 26 are selectively closed, the flow rates are selectively reduced until the last of the dispensing valves 26 is closed. Then the connector conduit valve 42 closes, flow from the receptacle 21 into the loop conduit 12 ceases, and the pump 13 which has been running all the time again effects complete circulation around the loop conduit 12 and flow of beverage within the return conduit 25 reverts back to its normal direction of flow from the dispensing head 15 back to the pump 13 through the return line 25.

During circulation, the connector valve 42 precludes short circuited flow of pumped circulating beverage in a reverse direction through the connector conduit 41. The second circulation pump 38 is provided primarily to back up the first pump 13 in event of failure. The second pump 38 may also be run concurrently with the first pump 13 during periods of abnormally high temperature in order to keep the dispensing head 15 cooled.

The reaction times are very fast. Two or more, or all of the valves 26 may be simultaneously opened and the flow reversed in the return line 25 and flow increase in the delivery line 24 are practically instantaneous.

There is a substantial pressure loss when most of the dispensing valves are open. As previously explained, the carbonated water in the receptacle 21 has about 4.5 volumes of carbonation and is under 100 PSIG (7.0 $Kg/cm^2$) carbon dioxide propellant gas pressure. After the carbonated water has been cooled by the coils 28, 31 to 0° C., the pressure required to retain the carbon dioxide in solution is about 23 PSIG (1.6 $Kg/cm^2$). During circulation flow, the pressure within the loop conduit 12 and dispensing head 15 is the full 100 PSIG (7 $Kg/cm^2$) pressure within the receptacle 21.

As the dispensing valves 26 are opened and flow increases, pressure has to be maintained at the valves 26 at least sufficient to keep the carbon dioxide in solution. As an example, when one of the valves 26 is open, the pressure at the head 15 is about 85 PSIG (6.0 Kg/cm$^2$); when two of valves 26 are open, 75 PSIG (5.2 Kg/cm$^2$); when three of valves 26 are open, 62 PSIG (4.3 Kg/cm$^2$); when four of valves 26 are open, 46 PSIG 3.2 Kg/cm$^2$); when five of valves 26 are open, 31 PSIG (2.2 Kg/cm$^2$); and when all six of valves 26 are open, 24 PSIG (1.7 Kg/cm$^2$). The valves 26 each have a volumetric flow control regulator which provides a constant volumetric flow as pre-adjusted.

The foregoing method and apparatus has been described with six dispensing valves 26 each having a flow rate of 1.2 oz./sec. (35 cm$^3$/sec.). Size increase of the dispensing apparatus 10 to include ten dispensing valves each having a flow rate of 2.5 oz./sec. (74 cm$^3$/sec.) and correspondingly larger beverage lines and conduits is intended. Existing soda circuits installed as integral components of existing buildings may be converted to the apparatus and method of this invention by utilizing the existing dispensing head and lines between the head and cooling device, and installing new cooling devices and connector conduits, pumps, supply conduits and larger carbonators.

The dispensing apparatus 10 and method as previously described have referred to carbonated water as the beverage being prepared, circulated and dispensed. As the carbonated water is dispensed, it is combined and mixed with a liquid flavor concentrate to form a soft drink such as cola, lemon-lime, orange and the like. The usual ratio is one part concentrate to five parts carbonated water. However, the carbonated water may be discretely withdrawn by itself.

This new apparatus and method has increased the dispensing capacity of soda circuits by more than twice without requiring new and larger beverage conduits, and has increased the thermal efficiency of these soda circuits.

Although other advantages may be found and realized, and various and minor modifications suggested by those versed in the art, be it understood that I wish to embody within the scope of the patent warranted hereon, all such embodiments as reasonably and properly come within the scope of my contribution to the art.

I claim as my invention:

1. A method of dispensing a carbonated beverage comprising the steps of:

(a) carbonating a previously uncarbonated beverage to a predetermined degree of saturation;

(b) storing a supply of the carbonated beverage under a predetermined propellant gas pressure;

(c) conducting the carbonated beverage from the supply and into a circulation loop;

(d) circulating the conducted carbonated beverage in a predetermined direction of flow around the loop and past a dispensing outlet;

(e) selectively dispensing carbonated beverage from the loop via the outlet; and concurrently with said step of dispensing, (f) reversing the direction of flow of carbonated beverage in part of the loop; and (g) propelling carbonated beverage from the supply into the loop and through the said part of the loop in a direction of flow toward the dispensing outlet and in said reversed direction.

2. A method according to claim 1, including the further step of increasing the rate of volumetric flow in the predetermined direction concurrently with the step of dispensing.

3. A method according to claim 2, in which the increased volumetric rate of flow is effected by the steps of:

(a) propelling beverage directly from the supply into the loop, and (b) dividing the so propelled beverage into two streams, the first of which flows in the predetermined direction and the second of which flows in the reverse direction.

4. A method according to claim 3, in which the first stream is combined with the remaining circulated flow.

5. A method according to either of claims 3 or 4, including the further steps of (a) dividing a third stream from the so propelled beverage; and (b) replacing the circulating flow in part of the loop with the third stream during the step of dispensing.

6. A method according to claim 5, in which the volumetric rate of flow of the second stream is approximately equal to the combined volumetric rate of flow of the first and third streams.

7. A method according to either of claims 1, 2 or 3, in which the volumetric rate of reverse flow is approximately equal to the volumetric rate of flow in the predetermined direction during the step of dispensing.

8. A method according to claim 1, including the step of cooling the reverse flow of beverage.

9. A method according to claim 8, including the separate and simultaneous step of cooling the flow of beverage in the predetermined direction during the step of dispensing, to substantially the same temperature as the cooled reverse flow.

10. A method according to claim 9, in which said steps of cooling are simultaneous, and affected by heat exchange to a common heat sink.

11. A method according to claim 1, including the steps of:

(a) fluidly connecting the supply directly to the loop on each side of the dispensing outlet prior to said step of reversing; and (b) fluidly disconnecting the supply from one side of the dispensing outlet upon termination of said step of reversing.

12. A method according to claim 1, including the steps of:

(a) pumping the circulating flow at a predetermined and fixed volumetric rate, and (b) dispensing at a volumetric rate substantially in excess of the pumped circulating rate.

13. A method according to claim 1, including the step of combining the reverse flowing beverage and the beverage flowing in the predetermined direction upon dispensing of the beverage from the respective flows.

14. A method according to claim 1, in which said step of circulating is at a predetermined and fixed volumetric rate, and in which said dispensing is of a plurality of discrete servings, the total volumetric flow rate of the servings being substantially in excess of the circulating flow rate, and in which approximately one half of the dispensing flow is provided by the reverse flow.

15. A method according to claim 1, including the steps of:

(a) opening the loop with respect to the supply and fluidly connecting the loop in parallel to the supply during the step of dispensing; and (b) closing the parallel connection between the loop and the supply upon termination of the step of dispensing.

16. A method according to claim 1, including the steps of
(a) selectively increasing the volumetric flow rate of dispensing; and
(b) increasing the volumetric flow rates of both the reverse flow and the flow in predetermined direction as the dispensing flow rate is increased.

17. A method according to claim 16, in which the reverse and predetermined direction flow rates are increased in approximately equal amounts.

18. A method according to either of claims 8, 9 or 10, in which the beverage in the reverse flow is initially cooled during such reverse flow.

19. A method of dispensing a carbonated beverage comprising the steps of:
(a) carbonating a previously uncarbonated beverage to a predetermined degree of saturation;
(b) storing a supply of the carbonated beverage under a predetermined propellant gas pressure;
(c) conducting the carbonated beverage from the supply and into a circulating loop;
(d) continually pumping the conducted carbonated beverage in a predetermined direction of flow around the loop and past a dispensing outlet;
(e) selectively dispensing carbonated beverage from the loop via the outlet; and concurrently with said step of dispensing,
(f) reversing the direction of flow of carbonated beverage in part of the loop under pressure from the supply;
(g) propelling carbonated beverage under the supply propellant gas pressure into the loop;
(h) dividing the so-propelled beverage into
(1) a first flow past the pump and through the loop in the predetermined direction toward the dispensing outlet; and
(2) a second flow in the reversed direction through the said part of the loop in a direction of flow toward the dispensing outlet; and
(i) drawing on both flows for the beverage being dispensed.

20. A method according to claim 19, including the step of combining the pumped flow and the first flow into a single flow to the dispensing outlet.

21. A method according to either of claims 19 or 20, including the step of cooling both flows of beverage.

22. A method according to claim 21, in which the second flow is initially cooled during such reverse flow.

23. A method according to claim 19, including the steps of:
(a) sequentially increasing the volumetric flow rate of the dispensing; and
(b) sequentially increasing both of the first and second flows in response to the dispensing increase.

24. A method according to claim 23, in which the first and second flows are increased in approximately equal amounts.

25. A method of dispensing a carbonated beverage comprising the steps of;
(a) carbonating a previously uncarbonated beverage to a predetermined degree of saturation;
(b) storing a supply of the carbonated beverage under a predetermined propellant gas pressure;
(c) conducting the carbonated beverage from the supply and into a circulation loop;
(d) pumping the conducted carbonated beverage in a predetermined direction of flow around the loop and past a dispensing outlet;
(e) cooling the circulating beverage being delivered between the pump and the dispensing outlet;
(f) cooling the dispensing outlet with the beverage being circulated therepast;
(g) re-cooling the circulating beverage being returned between the dispensing outlet and the pump;
(h) selectively dispensing carbonated beverage from the loop via the outlet; and concurrently with said step of dispensing,
(i) reversing the direction of flow of carbonated beverage in part of the loop; and
(j) propelling carbonated beverage from the supply into the loop and through the said part of the loop in a direction of flow toward the dispensing outlet and in said reversed direction; and
(k) cooling the so-propelled beverage while the beverage is flowing in the reverse direction toward the dispensing outlet.

26. A method according to claim 25, in which the so-propelled beverage is initially cooled while flowing in the reverse direction.

27. A method according to either of claims 25 or 26, in which the cooling during the reverse flow comprises the entire cooling of the reverse flowing beverage.

28. A method according to either of claims 25 or 26, including the step of propelling additional carbonated beverage from the supply into the loop, and through the loop in the predetermined direction and in parallel with the reverse flow to the dispensing outlet.

29. A method according to claim 26, including the further steps of
(a) propelling additional carbonated beverage from the supply into the loop, and through the loop in the predetermined direction and in parallel with the reverse flow to the dispensing outlet;
(b) initially and completely cooling that beverage which is flowing in the reverse direction while it is so flowing in the reverse direction; while simultaneously
(c) initially and completely cooling the propelled additional carbonated beverage while it is flowing in the loop and in the predetermined direction.

30. Apparatus for dispensing a carbonated beverage, comprising:
(a) means for carbonating a previously uncarbonated beverage;
(b) means fluidly communicable with said carbonating means for storing a supply of carbonated beverage under a predetermined propellant gas pressure;
(c) a carbonated beverage circulation loop conduit, said loop conduit having
(1) means for circulating carbonated beverage,
(2) a delivery line fluidly connected to an outlet of the circulating means,
(3) a return line fluidly connecting the delivery line to an inlet of the circulating means, and
(4) normally closed valve means for dispensing, said valve means being in fluid communication with and between the delivery and return lines;
(d) a supply conduit connecting the supply storing means to the return line between the inlet of the circulating means and the dispensing valve means;
(e) a supply connector conduit connecting the return line to the delivery line, said connector conduit being (1) connected to the return line between the inlet of the circulating means and the dispensing valve means, and being (2) connected to the delivery line between the outlet of the circulating means and the dispensing valve means; and (f) means in said supply connector conduit for precluding fluid flow from the delivery line to the return line through the connector conduit.

31. Apparatus according to claim 30, in which said circulating means is a pump having a volumetric flow rate of less than the volumetric flow rate of said valve means.

32. Apparatus according to claim 31, in which the pump is of positive displacement and constant volumetric flow rate.

33. Apparatus according to either of claims 30, 31 or 32, including a second such circulating means fluidly connected in the circulation conduit and in parallel with the first said circulating means.

34. Apparatus according to claim 30, in which the delivery line is in direct fluid communication with both of the circulating means and the supply connector conduit precluding means.

35. Apparatus according to either of claims 30 or 34, in which the return line is in direct fluid communication with an inlet to the circulating means and with an inlet to the supply connector conduit precluding means.

36. Apparatus according to either of claims 30 or 34, in which said precluding means is a pressure actuatable fluid check valve.

37. Apparatus according to claim 30, including means in each of the delivery line and the return line for cooling flow of beverage therethrough.

38. Apparatus according to claim 37, in which the cooling means in the return line has a thermal exchange capacity at least equal to the thermal exchange capacity of the delivery line cooling means.

39. Apparatus according to claim 38, in which the return line cooling means and the delivery line cooling means are substantially identical.

40. Apparatus according to either of claims 37, 38 or 39, including a single heat sink common to both of the cooling means.

41. Apparatus according to either of claims 37, 38 or 39, in which the cooling means are fluidly between the dispensing valve means and the supply connector conduit.

42. Apparatus according to either of claims 37, 38 or 39, in which each of the cooling means are tubular metal coils in heat exchange relationship with an ice bank.

43. Apparatus according to either of claims 37, 38 or 39, in which both of the circulating means and the supply connector conduit are to the same side of the cooling means.

44. Apparatus according to either of claims 31 or 32, in which said valve means comprise a plurality of concurrently openable dispensing valves, each of said dispensing valves having a volumetric flow rate greater than the volumetric flow rate of said pump.

45. Apparatus according to claim 30, in which the supply conduit has a larger internal cross section than either of the delivery line or the return line.

46. Apparatus according to either of claims 30 or 31, in which (a) the return line is in direct fluid communication with both of (1) an inlet to the circulating means, and (2) an inlet to the supply connector conduit precluding means; and in which (b) said precluding means comprises a pressure actuated fluid check valve.

47. Apparatus according to either of claims 31 or 32, including (a) a second such circulating means fluidly connected into the circulation conduit and in parallel with the first said circulating means; and (b) in which said valve means comprise a plurality of concurrently openable dispensing valves, each of said dispensing valves having a volumetric flow rate greater than the volumetric flow rate of either of said pumps.

48. Apparatus for dispensing a carbonated beverage, comprising:

(a) means for carbonating a previously uncarbonated beverage;

(b) means fluidly communicable with said carbonating means for storing a supply of carbonated beverage under a predetermined propellant gas pressure;

(c) a carbonated beverage circulation loop conduit, said loop conduit having (1) means for circulating carbonated beverage, (2) a delivery line fluidly connected to an outlet of the circulating means, (3) a return line fluidly connecting the delivery line to an inlet of the circulating means, and (4) normally closed valve means for dispensing, said valve means being in direct fluid communication with both of and being in between the delivery and return lines;

(d) a supply conduit fluidly connecting the supply storing means directly to an outlet end of the return line adjacent the inlet of the circulating means, said supply conduit being in unobstructed fluid communication with the valve means via the return line; and (e) means in fluid communication with the loop conduit and the supply storage means and responsive to a drop in pressure in the delivery line to less than the supply pressure for conducting carbonated beverage from the supply storage means into the delivery line at a volumetric rate of flow in excess of the volumetric rate of flow of the circulating means.

49. Apparatus according to claim 48, including discrete cooling coils in each of the delivery line and the return line, with the return line coils being in direct fluid communication with the supply storing means, for discretely cooling beverage being propelled from the storing means to the dispensing valve means in each of the delivery line and the return line respectively, during discrete flow through each of the delivery line and the return line of previously uncooled beverage toward the dispensing valve means.

50. Apparatus for dispensing a carbonated beverage comprising:

(a) means for carbonating a previously uncarbonated beverage;

(b) means fluidly communicable with said carbonating means for storing a supply of carbonated beverage under a predetermined propellant gas pressure;

(c) a carbonated beverage circulation loop conduit, said loop conduit having:

(1) a delivery line, (2) a return line in unobstructed fluid communication with the downstream end of the delivery line, (3) normally closed valve means for dispensing beverage from the loop conduit, said valve means being in unobstructed fluid communication with both of and being in between the delivery and return lines, and (4) means for circulating carbonated beverage within and around the loop in a single direction, said circulating means having an outlet connected to an inlet of the delivery line and an inlet connected to an outlet of the return line, with both of the delivery line inlet and the return line outlet being in unobstructed fluid communication with the valve means; and (d) means connecting the supply storing means to the delivery line inlet and to the return line outlet for supplying a flow of carbonated beverage from the storing means under the propellant gas pressure into each of the inlet of the delivery line and the outlet of the return line.

51. Apparatus according to claim 50, including discrete and substantially thermally equivalent cooling coils in each of the delivery line and the return line, for discretely cooling discrete flow of previously uncooled beverage in each of the lines.

52. Apparatus for dispensing a carbonated beverage comprising:

(a) means for carbonating a previously uncarbonated beverage;

(b) means fluidly communicable with said carbonating means for storing a supply of carbonated beverage under a predetermined propellant gas pressure;

(c) a beverage supply conduit fluidly extending from said supply storing means;

(d) normally closed valve means for dispensing beverage originating from the storing means;

(e) a delivery line unobstructedly fluidly connecting the supply conduit to the valve means;

(f) a return line unobstructedly fluidly connecting the supply conduit directly to the valve means in parallel with the delivery line, said lines being in unobstructed fluid communication past the valve means; and (g) means common to and in unobstructed fluid communication with both of said lines for continually circulating a flow of carbonated beverage in the delivery line to the valve means and from the valve means back through the return line for recirculation.

53. Apparatus according to claim 52, including cooling coils in the delivery line for cooling flow of beverage therethrough, and thermally equivalent discrete cooling coils in the return line for cooling an equivalent but discrete flow of beverage therethrough and in parallel with flow through the delivery line.

54. Apparatus for dispensing carbonated beverage, comprising:

(a) supply means for storing a supply of carbonated beverage under a predetermined carbon dioxide propellant gas pressure;

(b) a beverage circulating loop conduit, said loop conduit having (1) means for continually circulating beverage within the loop, (2) a delivery line having an inlet fluidly connected to an outlet of the circulating means, (3) a return line fluidly connecting the delivery line to an inlet of the circulating means, (4) a plurality of normally closed beverage dispensing valves which are fluidly in between and which are in direct fluid communication with both of the delivery and return lines, and (5) discrete cooling means in each of the delivery and return lines for discretely cooling beverage in each of the delivery and return lines respectively;

(c) a beverage supply conduit fluidly connecting the supply means to both of (1) the inlet end of the delivery line in between the circulating means and the delivery line cooling means, and to (2) the outlet end of the return line in between the return line cooling means and the circulating means; and (d) means in said supply conduit for enabling flow of beverage through the supply conduit and into the delivery line, and for precluding flow of beverage from the delivery line into the supply conduit.

55. Apparatus according to claim 54, in which (a) said precluding means in the supply conduit is normally closed; and (b) the supply means is in unobstructed direct fluid communication with the return line cooling means.

56. A method of dispensing carbonated beverage comprising the steps of:

(a) storing a supply of carbonated beverage under a predetermined propellant gas pressure;

(b) conducting the carbonated beverage from the supply and into a circulation loop under the gas pressure;

(c) pumping the conducted carbonated beverage in a predetermined direction of flow around the loop and past a dispensing outlet;

(d) cooling the circulating beverage being delivered to the dispensing outlet in between the pump and the dispensing outlet;

(e) re-cooling the circulating beverage being returned to the pump in between the dispensing outlet and the pump;

(f) selectively dispensing carbonated beverage from the loop via the outlet; and concurrently with said step of dispensing, (1) reversing the direction of flow of carbonated beverage in part of the loop, and (2) propelling carbonated beverage from the supply into the loop and through the said part of the loop in a direction of flow toward and to the dispensing outlet and in said reversed direction; and (3) cooling the so-propelled beverage while the beverage is flowing in the reverse direction toward the dispensing outlet.

* * * * *